US007383821B2

(12) United States Patent
Gras et al.

(10) Patent No.: US 7,383,821 B2
(45) Date of Patent: Jun. 10, 2008

(54) APPARATUS FOR PUMPING FUEL FROM A TANK TO AN INTERNAL COMBUSTION ENGINE, AND METHOD FOR PRESSURE DETECTION

(75) Inventors: Juergen Gras, Bietigheim-Bissingen (DE); Christian Sobottka, Stuttgart (DE); Karl-Bernhard Lederle, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 113 days.

(21) Appl. No.: 10/579,851

(22) PCT Filed: Oct. 29, 2004

(86) PCT No.: PCT/EP2004/052724

§ 371 (c)(1),
(2), (4) Date: May 17, 2006

(87) PCT Pub. No.: WO2005/052349

PCT Pub. Date: Jun. 9, 2005

(65) Prior Publication Data

US 2007/0108856 A1 May 17, 2007

(30) Foreign Application Priority Data

Nov. 28, 2003 (DE) ..... 103 55 804

(51) Int. Cl.
*F02M 37/04* (2006.01)
*F02M 37/08* (2006.01)

(52) U.S. Cl. ..... 123/509

(58) Field of Classification Search ..... 123/509, 123/456, 468, 469, 497, 457, 511; 137/571, 137/576

See application file for complete search history.

(56) References Cited

U.S. PATENT DOCUMENTS

| | | | | |
|---|---|---|---|---|
| 4,920,942 | A | 5/1990 | Fujimori et al. | |
| 5,148,792 | A | 9/1992 | Tuckey | |
| 5,398,655 | A | 3/1995 | Tuckey | |
| 5,579,739 | A | 12/1996 | Tuckey et al. | |
| 5,590,631 | A | 1/1997 | Tuckey | |
| 5,727,529 | A | 3/1998 | Tuckey | |
| 5,961,293 | A | 10/1999 | Clemmons et al. | |
| 6,302,144 | B1 * | 10/2001 | Graham et al. | 137/565.17 |
| 6,412,475 | B1 | 7/2002 | Joos et al. | |
| 6,769,406 | B2 * | 8/2004 | Ohta et al. | 123/458 |

(Continued)

FOREIGN PATENT DOCUMENTS

| | | |
|---|---|---|
| DE | 195 22 512 A1 | 2/1996 |

(Continued)

*Primary Examiner*—Mahmoud Gimie
(74) *Attorney, Agent, or Firm*—Ronald E. Greigg

(57) ABSTRACT

An apparatuses for pumping fuel to an internal combustion engine has a feed pump, a pressure line leading from the feed pump to the internal combustion engine, a check valve, and a pressure sensor connected to the pressure line is operatively connected to the pressure line downstream of the feed pump and upstream of the check valve. The measurement signal of the pressure sensor is used as a controlled variable for regulating the feed pump and/or for a leak diagnosis in the pressure line and/or for a tank leak diagnosis. The apparatus according to the invention is simplified because only a single pressure sensor is provided for the pressure change in the pressure line and in the tank.

11 Claims, 1 Drawing Sheet

U.S. PATENT DOCUMENTS

| | | | | |
|---|---|---|---|---|
| 6,772,738 | B2 * | 8/2004 | Rembold et al. | 123/514 |
| 7,121,265 | B2 * | 10/2006 | Joos et al. | 123/494 |
| 7,213,584 | B2 * | 5/2007 | Ohhashi et al. | 123/519 |
| 2002/0083923 | A1 * | 7/2002 | Suzuki et al. | 123/464 |
| 2002/0184938 | A1 | 12/2002 | Isobe et al. | |
| 2003/0098016 | A1 * | 5/2003 | Rembold et al. | 123/457 |
| 2003/0200956 | A1 * | 10/2003 | Ohta et al. | 123/458 |
| 2003/0226399 | A1 * | 12/2003 | Clingerman et al. | 73/119 A |
| 2005/0005912 | A1 * | 1/2005 | Joos et al. | 123/458 |

FOREIGN PATENT DOCUMENTS

| | | | |
|---|---|---|---|
| DE | 199 36 287 | A1 | 2/2001 |
| DE | 100 43 688 | A1 | 3/2002 |
| EP | 0 886 056 | A1 | 12/1998 |
| EP | 0 952 332 | A2 | 10/1999 |
| FR | 2 725 245 | A1 | 4/1996 |
| WO | WO 98/04824 | A1 | 2/1998 |

* cited by examiner

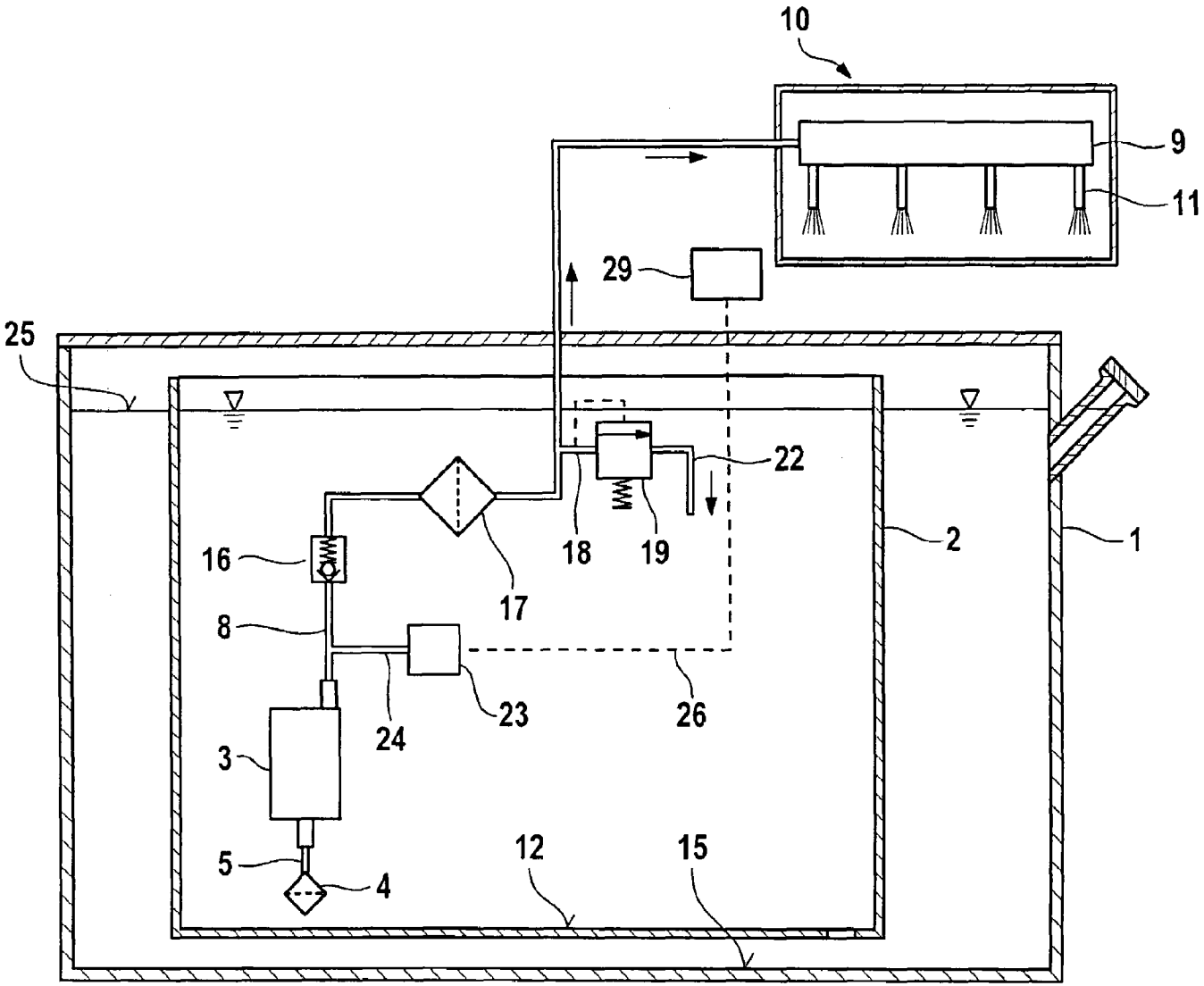
10
9
11
29
22
19
18
17
16
8
24
23
26
25
2
1
15
12
3
5
4

APPARATUS FOR PUMPING FUEL FROM A TANK TO AN INTERNAL COMBUSTION ENGINE, AND METHOD FOR PRESSURE DETECTION

CROSS-REFERENCE TO RELATED APPLICATIONS

This application is a 35 USC 371 application of PCT/EP 2004/052724 filed on Oct. 29, 2004.

BACKGROUND OF THE INVENTION

1. Field of the Invention

The invention is directed to an improved apparatus for and method of feeding fuel from a tank to an internal combustion engine.

2. Description of the Prior Art

One apparatus for feeding fuel to an internal combustion engine, known from German Patent Disclosure DE 10043 688 A1, has a feed pump, a pressure line leading from the feed pump to the engine, a check valve located in the pressure line downstream of the feed pump, and a pressure sensor communicating with the pressure line. The pressure line is provided on a so-called fuel distributor and detects the pressure in the fuel distributor and in the pressure line. For a so-called tank leak diagnosis, one additional pressure sensor in the tank is necessary, if a leak in the tank is to be detectable.

SUMMARY AND ADVANTAGES OF THE INVENTION

The apparatus of the invention and the method of the invention have the advantage over the prior art that the production costs for the apparatus can be reduced in a simple way by providing that the pressure sensor is operatively connected to the pressure line downstream of the feed pump and upstream of the check valve.

It is advantageous if the pressure sensor has a temperature sensor, since in this way the temperature of the fuel aspirated from the tank is ascertained in addition.

It is especially advantageous if the pressure sensor is used for pressure detection in the pressure line and for pressure detection in the tank. In an advantageous exemplary embodiment, the pressure sensor is operatively connected to the pressure line downstream of the feed pump and upstream of the check valve, and the measurement signal of the pressure sensor is used as a controlled variable for regulating the feed pump and/or for a leak diagnosis in the pressure line and/or for a tank leak diagnosis. The pressure sensor can take on one or more of the aforementioned functions to suit customer wishes. No additional components are necessary.

It is also advantageous that in the tank leak diagnosis, the course of pressure over time in the tank is measured, since in this way a leak in the tank can be detected.

In an advantageous feature, in the tank leak diagnosis, it is concluded that there is a leak in the tank if, after a predetermined diagnosis time, a pressure change is measured that is greater than a predetermined pressure change, there being an overpressure or underpressure in the tank before the beginning of the tank leak diagnosis. Advantageously, it is also concluded that there is a leak in the tank if, after a predetermined diagnosis time, a pressure change is measured that is less than a predetermined pressure change, there being atmospheric pressure in the tank before the beginning of the tank leak diagnosis.

In an advantageous exemplary embodiment, in the pressure line leak diagnosis, it is concluded that there is a leak in the pressure line downstream of the check valve if the measurement signal of the pressure sensor drops below a predetermined value.

BRIEF DESCRIPTION OF THE DRAWING

One exemplary embodiment of the invention is described fore fully herein below, in conjunction with the single drawing figure which is a simplified schematic illustration of a fuel system according to the invention.

DESCRIPTION OF THE PREFERRED EMBODIMENT

The apparatus of the invention has a tank 1, with a reservoir 2 located for instance in tank 1, in which reservoir there is a feed pump 3 which aspirates fuel, stored in the tank 1, out of the reservoir 2 for instance via a prefilter 4 and an intake line 5 and pumps it with increased pressure via a pressure line 8, for instance to a fuel distributor 9 of an internal combustion engine 10.

The fuel distributor 9 is defined as part of the pressure line 8. The fuel distributor 9 communicates with a plurality of injection valves 11, which in a manner not shown inject the fuel into an intake tube or cylinder of the engine 10. The pressure line 8 may also communicate downstream with a high-pressure pump of a so-called direct gasoline injection or diesel injection system, which injects the fuel at high pressure into the fuel distributor and via injection valves into cylinders of the engine 10.

The reservoir 2 for example keeps enough fuel on hand that a supply of fuel to the engine 10 by the feed pump 3 is assured even if no fuel is pumped into the reservoir 2, for short times such as when the vehicle is cornering, causing sloshing of the fuel in the tank 1. The reservoir 2 is filled in a known way via a suction jet pump, not shown, that is supplied by the feed pump 3 and that pumps fuel out of the tank 1 into the reservoir 2.

The reservoir 2 is located with its cup base 12 near a base 15 of the tank 1.

The feed pump 3 is for instance a flow pump, which is driven electrically by an actuator, such as an armature of an electric motor, but it may also be some arbitrary other kind of pump.

The prefilter 4 protects the apparatus downstream of the prefilter 4 from coarse dirt particles contained in the fuel.

A check valve 16 is for instance located in the pressure line 8 downstream of the feed pump 3; it prevents a reverse flow of fuel from downstream of the check valve 16 to upstream of the check valve 16 and in this way maintains the overpressure, built up by the feed pump 3 in the pressure line 8 downstream of the check valve 16, even after the feed pump 3 has been shut off. Downstream of the check valve 16, a main filter 17 is for instance provided, which filters out the fine dirt particles contained in the fuel. Downstream of the main filter 17, a branch line 18 branches off from the pressure line 8. The branch line 18 communicates with a pressure regulator 19, which opens at a pressure in the pressure line 8 that is greater than a predetermined opening pressure and causes fuel to flow out of the pressure line 8 back into the reservoir 2 via the branch line 18, the opened pressure regulator 19, and a return line 22. In this way, the pressure in the pressure line 8 is kept at a constant value.

According to the invention, the apparatus has a pressure sensor 23, which is operatively connected, for instance fluidically, with the pressure line 8 downstream of the feed pump 3 and upstream of the check valve 16 via a connecting line 24. The pressure sensor 23 for instance measures a differential pressure with respect to the atmosphere, or an absolute pressure. A measurement signal of the pressure sensor 23 corresponding to the measured pressure is carried via a signal line 26 to an electronic engine controller 29.

According to the invention, the pressure sensor 23 is used for pressure detection in the pressure line 8 and for the pressure detection in the tank 1.

The measurement signal of the pressure sensor 23 serves for instance as a so-called controlled variable for regulating the feed pump 3, so that only the quantity of fuel needed in the operating state of the engine 10 at the time is pumped to the fuel distributor 9. The feed pump 3 therefore requires less electrical capacity than an unregulated feed pump 3, which runs at full power regardless of the operating state of the engine 10. The result is a significant fuel saving. Because of this regulation of the feed pump 3 with the measurement signal of the pressure sensor 23 as a controlled variable, the branch line 18 with the pressure regulator 19 and the return line 22 can be eliminated. The measurement signal of the pressure sensor 23 may also serve as a so-called controlled variable for regulating a high-pressure pump, located in the pressure line 8 downstream of the check valve 16, with the same advantages as those named above.

The pressure sensor 23 can also be used for a leak diagnosis in the pressure line 8, 9. In this pressure line leak diagnosis, it is concluded that there is a leak in the pressure line 8, 9 if the measurement signal of the pressure sensor 23, with the feed pump 3 switched on, drops below a predetermined value.

The pressure sensor 23 is furthermore used according to the invention for a tank leak diagnosis. It is known that tank leak diagnosis processes function such that the course over time of an overpressure or underpressure prevailing in the tank 1 is measured. The overpressure or underpressure in the tank 1 can be generated by means of a pump. Moreover, in a known manner, the natural warming up of the tank 1 after the engine 10 of a vehicle is shut off, which causes a slight pressure increase in the tank 1, can be utilized.

The tank leak diagnosis is performed for instance after the engine 10 is shut off, if the tank 1 is hermetically sealed off from the environment. To that end, for instance the feed pump 3 is shut off, the check valve 16 is closed, and a tank venting line, not shown, leading from the tank 1 to the engine 10 is closed by the closure of a tank venting valve provided in the tank venting line. An activated charcoal container is for instance located in the tank venting line, upstream of the tank venting valve, and communicates via a ventilation line with the atmosphere, and in the ventilation line a further valve is provided, which is also closed before the tank leak diagnosis is performed.

If the overpressure or underpressure in the tank 1 diminishes too fast, it is concluded that there is a leak in the tank 1.

In the disposition of the pressure sensor 23 according to the invention, the pressure sensor 23 measures the pressure in the pressure line 8 downstream of the feed pump 3 and upstream of the check valve 16.

With the feed pump 3 switched on, the check valve 16 is opened, because of the pumping of fuel in the direction of the engine 10, so that the pressure in the pressure line 3 downstream of the feed pump 3 and upstream of the check valve 16, minus pressure losses at the check valve 16 and the pressure line 8, corresponds to the pressure in the pressure line 8 downstream of the check valve 16 and the pressure in the fuel distributor 9. The pressure in the pressure line 8 downstream of the check valve 16 and the pressure in the fuel distributor 9 will be hereinafter referred to as the system pressure. Since the system pressure is the desired controlled variable, the engine controller 29 corrects the measurement signal of the pressure sensor 23 by the pressure loss, for instance at the check valve 16, the main filter 17, and/or the pressure line 8, 9.

With the feed pump 3 shut off, the check valve 16 is closed, and the overpressure built up by the feed pump 3 and the pressure line 8 upstream of the check valve 16 has dropped to a lesser pressure, which, since the pressure line 8 upstream of the check valve 16 communicates fluidically with the reservoir 2 via the feed pump 3, the intake line 5, and the prefilter 4, is composed of a pressure component, hereinafter called the gas pressure, of a gas formed of fuel vapors and air above a surface 25 of the liquid in the tank 1 and the reservoir 2, and a hydrostatic pressure component, which is dependent on a fill level in the tank 1 and in the reservoir 2 and is formed by the pressure of a so-called liquid column above the branch line 24.

Since for the tank leak diagnosis the course over time of the gas pressure is observed, it does not matter that the pressure sensor 23, when the feed pump 3 has been switched off, does not measure the gas pressure but rather a pressure that is composed of the gas pressure and a hydrostatic pressure component, the latter being dependent on the fill level. It is unnecessary to correct the measurement signal of the pressure sensor 23 with the hydrostatic pressure component, since the fill level in the tank 1 and in the reservoir 2 remains constant during the tank leak diagnosis, and only the pressure change in the tank 1 is monitored.

After the shutoff of the feed pump 3, the tank leak diagnosis can be started in accordance with an arbitrary criterion. The engine controller 29 monitors the course over time of the measurement signal of the pressure sensor 23. If the overpressure or underpressure already exists in the tank 1 the tank leak diagnosis begins, for instance having been generated by a pump or by natural, temperature-dictated pressure buildup, it is concluded that a leak is present if, after a predetermined diagnosis time, a pressure change is ascertained that is greater than a predetermined pressure change. This conclusion is drawn from the fact that the overpressure or underpressure in the tank 1 decreases because of a leak, causing a pressure change that is greater than the predetermined pressure change. If in the tank leak diagnosis the natural pressure buildup in the tank 1 by the natural warming of the tank 1 after the shutoff of the engine 10 of a vehicle is monitored, and atmospheric pressure prevails in the tank 1 before the tank leak diagnosis begins, then it is concluded that a leak has occurred, if after a predetermined diagnosis time a pressure change that is less than a predetermined pressure change is ascertained. This conclusion is drawn from the fact that in the presence of a leak in the tank 1, no overpressure, or only a slight overpressure, can become established in the tank 1.

The foregoing relates to a preferred exemplary embodiment of the invention, it being understood that other variants and embodiments thereof are possible within the spirit and scope of the invention, the latter being defined by the appended claims.

The invention claimed is:

1. An apparatus for feeding fuel from a tank to an internal combustion engine comprising:

a feed pump, a pressure line leading from the feed pump to the engine, a check valve located in the pressure line downstream of the feed pump, a pressure sensor fluidically communicating with the pressure line and generating a measurement signal corresponding to the measured pressure, the pressure sensor being operatively connected to the pressure line downstream of the feed pump and upstream of the check valve, the feed pump and the pressure sensor being located in the tank, and an electronic controller for determining the pressure in the pressure line and the pressure in the tank as a function of the measurement signal supplied to the controller.

2. The apparatus in accordance with claim 1, wherein the pressure sensor has a temperature sensor.

3. A method for pressure detection, employing an apparatus for feeding fuel from a tank to an internal combustion engine, a feed pump, a pressure line leading from the feed pump to the engine, a check valve located in the pressure line downstream of the feed pump, a pressure sensor fluidically communicating with the pressure line and an electronic controller, the method comprising operatively connecting the pressure sensor to the pressure line downstream of the feed pump and upstream of the check valve, transmitting a measurement signal representing the measured pressure in the pressure line from the pressure sensor to the electronic controller, and determining the pressure in the pressure line during a first operating status and the pressure in the tank during a second operating status using the measurement signal transmitted to the controller.

4. The method in accordance with claim 3, wherein the feed pump and the pressure sensor are located in the tank.

5. The method in accordance with claim 3, including the step of regulating the feed pump using the measurement signal transmitted to the controller.

6. The method in accordance with claim 3, including the step of determining the presence of a leak in the pressure line downstream of the check valve and/or in the tank using the measurement signal transmitted to the controller.

7. The method in accordance with claim 5, including the step of determining the presence of a leak in the pressure line and/or in the tank using the measurement signal transmitted to the controller.

8. The method in accordance with claim 6, wherein the step of determining the presence of a leak in the tank includes the steps of measuring the course of pressure in the tank over time and transmitting the measured signals to the controller.

9. The method in accordance with claim 6, wherein the step of determining the presence of a leak in the tank includes the step of generating a signal indicating the presence of a leak in the tank if, after a predetermined diagnosis time, a pressure change is measured that is greater than a predetermined pressure change, and there is an overpressure or underpressure in the tank before the beginning of the tank leak diagnosis.

10. The method in accordance with claim 6, wherein the step of determining the presence of a leak in the tank includes the step of generating a signal indicating the presence of a leak in the tank if, after a predetermined diagnosis time, a pressure change is measured that is less than a predetermined pressure change, and there is atmospheric pressure in the tank before the beginning of the tank leak diagnosis.

11. The method in accordance with claim 6, wherein in the step of determining the presence of a leak in the pressure line downstream of the check valve includes the step of generating a signal indicating the presence of a leak, if the measurement signal of the pressure sensor drops below a predetermined value.

* * * * *